United States Patent [19]

Bruner

[11] Patent Number: 4,763,490

[45] Date of Patent: Aug. 16, 1988

[54] OPENABLE RING WITH SAFETY LOCKING MEANS

[76] Inventor: Mates A. Bruner, 14 Barbara La., Havertown, Pa. 19083

[21] Appl. No.: 899,280

[22] Filed: Aug. 22, 1986

[51] Int. Cl.[4] ..... A44C 9/00

[52] U.S. Cl. ..... 63/15.7; 63/7; 24/241 S; 24/615

[58] Field of Search ..... 63/15.3, 15.7, 15.5, 63/15.45, 15.4, 7; 24/241 S, 232 R, 230.5 TP, 231, 241 P, 241 SP, 615, 616; 59/89

[56] References Cited

U.S. PATENT DOCUMENTS

| | | | |
|---|---|---|---|
| 145,788 | 12/1873 | Cottle | 63/7 |
| 804,137 | 11/1905 | Kent . | |
| 1,003,696 | 9/1911 | Briggs | 63/15.7 X |
| 1,209,083 | 12/1916 | Wagner | 24/241 S |
| 1,296,435 | 3/1919 | Schmidt | 63/15.7 |
| 2,045,282 | 6/1936 | Metcalf | 63/7 |
| 3,204,426 | 9/1965 | Armstrong | 63/15.5 |
| 3,221,514 | 12/1965 | Newman | 63/15.7 |
| 3,465,563 | 9/1969 | Verdickt | 72/96 |
| 3,736,770 | 6/1973 | Kelrick | 63/15.7 |

FOREIGN PATENT DOCUMENTS

| | | | |
|---|---|---|---|
| 2303498 | 10/1976 | France | 63/15.7 |
| 87327 | 1/1958 | Netherlands . | |

*Primary Examiner*—Richard J. Johnson

*Attorney, Agent, or Firm*—Caesar, Rivise, Bernstein, Cohen & Pokotilow, Ltd.

[57] ABSTRACT

A ring including a pair of semi-circular sections. The sections are pivotally connected to each other so that they can be pivoted apart to open the ring. The ring is secured together via latch means. One section of the ring is arcuate in shape and has an arcuate extending member projecting therefrom and adapted to enter and move through a mating recess formed in the other section. A primary locking spring is connected to the extending member and includes a portion adapted to engage a wall portion in the recess of the other section to lock the two sections together. An aperture is provided in the recess to enable the spring to disengaged, via the insertion of a sharply pointed instrument therethrough, thereby enabling the two sections to pivot outward with respect to each other to partially open the ring. A secondary locking spring is also mounted on the extension and is arranged to engage the wall portion contiguous with the opening to prevent the two sections from opening further until the pointed instrument is again inserted through the aperture to the deflect the second spring out of engagement with the wall portion, thereby enabling the two sections to be fully opened. When fully opened the ring can be placed about the finger of a person whose knuckle would otherwise be too large to enable a circular ring to be slid thereover. The two springs thus serve as releasable securement means preventing the accidental disconnection of the ring from the finger.

16 Claims, 2 Drawing Sheets

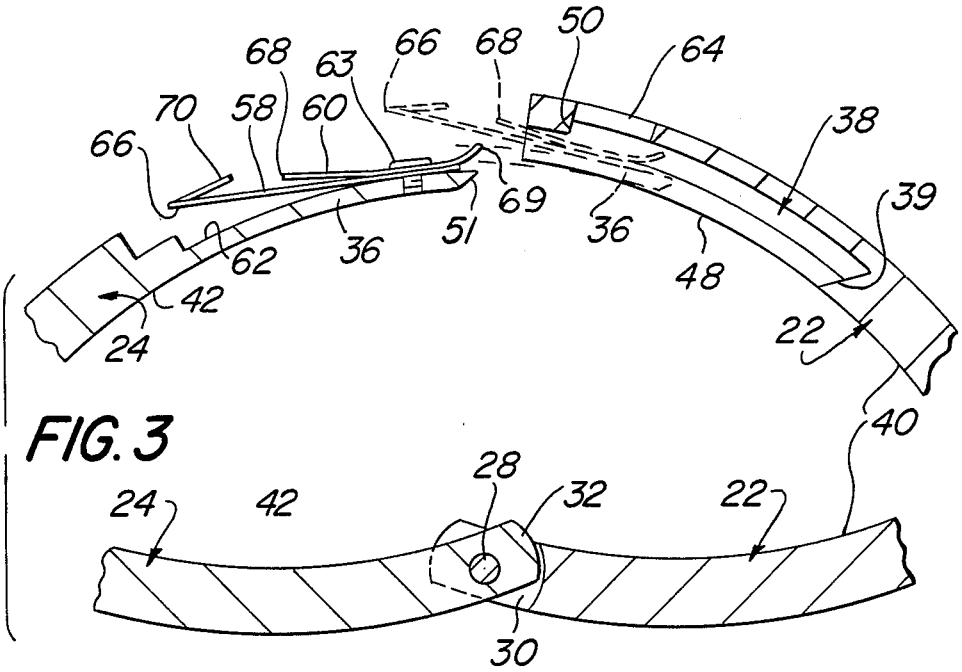
FIG. 3
FIG. 4
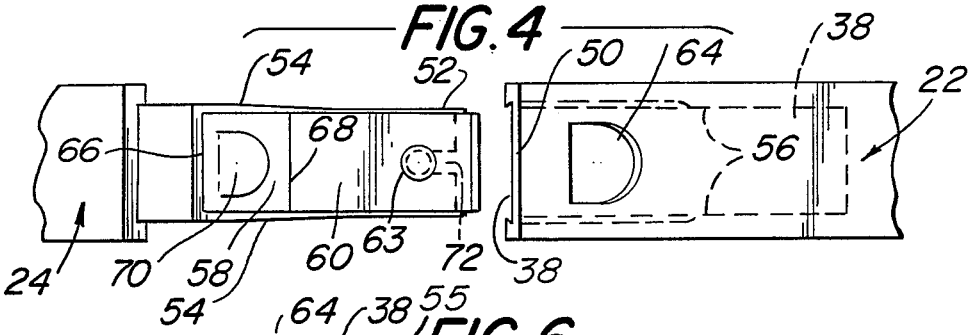
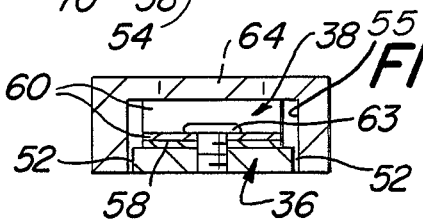
FIG. 6
FIG. 8
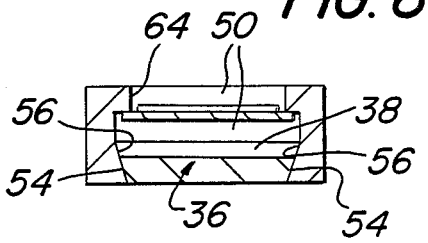
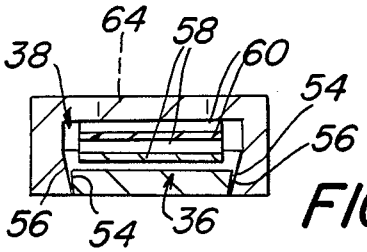
FIG. 7

OPENABLE RING WITH SAFETY LOCKING MEANS

BACKGROUND OF THE INVENTION

This invention relates generally to ring-like objects designed to be worn as jewelry, and more particularly to rings which are enabled to be releasably opened for fitting about a portion of the wearer's body, e.g. finger, and which are resistant to accidental opening.

Conventional finger rings or other jewelry arranged to be worn about a portion of the body must have a sufficient diameter to slide over the knuckle or other bony protuberance adjacent the point at which the ring is to be worn. Normally, such action does not present any problem since the difference in diameter between the bony protuberance, e.g., knuckle, and the portion on which the ring is worn is sufficient so that a properly fitted ring is comfortable to wear, put on and remove. However, there are numerous individuals who, for a variety of reasons, such as bone fractures, arthritis, etc., have enlarged knuckles or other protuberances which prevent their wearing of conventional jewelry.

The prior art includes adjustable, expandable and openable jewelry rings. For example, some of the prior art discloses rings which are adjustable in size through a specific range. Such rings are limited to a fixed expansion and are hence adapted to permanently remain one particular size. They are also generally constructed so that they can expand only to a limited degree, thus, limiting the size of a knuckle or other protuberance over which they may fit. The prior art also discloses openable rings which are designed for repeated openings. However, many of these rings are constructed and designed so that they pinch the wearer's skin when they are closed.

Examples of prior art adjustable or openable ring-like jewelry are found in the Netherlands patent No. 87,327 (Goldrick) and the following U.S. Pat. Nos.: 804,137 (Kent), 1,296,435 (Schmidt), 3,204,426 (Armstrong), 3,221,514 (Newman), 3,465,563 (Baker), and 3,736,770 (Kelrick).

While prior art rings are generally suitable for their intended purposes, they still leave much to be desired from the standpoint of utility, ability to provide an aesthetically pleasing appearance, and resistance to accidental opening.

OBJECTS OF THE INVENTION

Accordingly, it is a general object of the instant invention to provide a ring which overcomes the disadvantages of the prior art.

It is a further object of the instant invention to provide a ring which is formed of a pair of hingedly connected sections which can be pivoted open, but which includes safety latching means to insure that it cannot become accidently opened.

It is still a further object of the instant invention to provide a ring which includes safety latch mechanism which is simple in construction and effective in operation yet is sufficiently compact to enable the ring to be is aesthetically pleasing in appearance.

SUMMARY OF THE INVENTION

These and other objects of the instant invention are achieved by providing a ring to be worn as an article of jewelry by a person. The ring includes a first arcuate section and a second arcuate section. The first arcuate section includes a recess therein having an aperture located adjacent the free end of the recess and a wall portion adjacent the aperture. The second arcuate section is pivotally connected to the first section and has an arcuate extending member projecting therefrom and adapted to move through the recess in the first section from a partially opened position, wherein the extending member is located partially within the recess, to a closed position wherein the extending member is located fully within the recess. The arcuate extending member includes first spring means connected thereto and having a first locking portion. The ring also includes second locking means connected to the extending member and having a second locking portion. The first locking portion is adapted to engage the wall portion of the first section when the extending member is fully disposed within the recess to thereby lock the first section to the second section. The second locking means is arranged to engage a portion of the first section when the extending member is partially disposed within the recess to serve as a back-up or safety lock.

The aperture in the first section provides access for a sharply pointed instrument, such as a pencil or pen point, to engage the first spring means to move its locking portion out of engagement with the wall portion and thereby release the latch to permit the first and second sections to be pivoted away from each other, whereupon the ring can be opened to a partially opened configuration.

In the preferred embodiment of the invention the second locking means also comprises spring means and its second locking portion is adapted to engage the wall portion of the first section when the extending member is partially disposed within the recess. The aperture in the first section also provides access to the secohd spring means when the ring is in the partially opened position to move the locking portion of the second spring means out of engagement with the wall portion, whereupon the first section to be pivoted from the second section to the fully opened position.

DESCRIPTION OF THE DRAWING

Other objects and many of the attendant advantages of the instant invention will be readily appreciated when the same becomes better understood by reference to the following detailed description when considered in connection with the accompanying drawing wherein:

FIG. 3 is a view, similar to that of FIG. 2, but showing the ring in an open position;

FIG. 4 is the top plan view of the latching means of the ring shown in FIG. 1;

FIG. 6 is a sectional view taken along line 6—6 of FIG. 2;

FIG. 7 is a sectional view taken along line 7—7 of FIG. 2;

FIG. 8 is a sectional view taken along line. 8—8 of FIG. 2;

DETAILED DESCRIPTION OF THE PREFERRED EMBODIMENT

Figure 1:
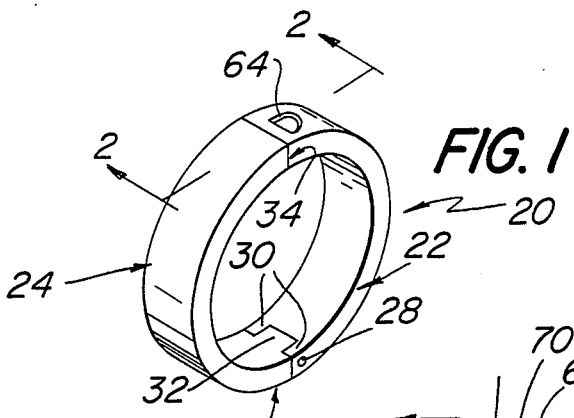
FIG. 1 is a perspective view of a ring constructed in accordance with the subject invention.
Figure 5:
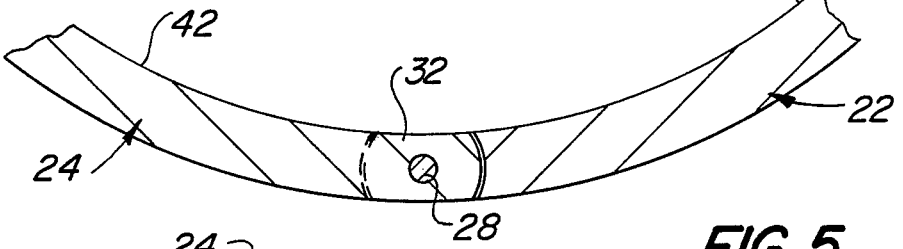
FIG. 5 is the bottom plan view of the hinge portion of the spring shown in FIG. 1.

Referring now to the various figures of the drawing wherein like reference characters refer to like parts, there is shown as 20 in FIG. 1 a ring constructed in accordance with the subject invention. The ring 20 basically comprises a pair of sections 22 and 24. Each section is formed of a rigid material, such as precious metal, and is of generally semi-circular shape. The two sections 22 and 24 are hingedly connected together at 26 by a pin 28. As can be seen clearly in FIG. 5 the pin 28 extends through aligned openings in a yoke 30 in one end of section 22 and through an aligned opening in a tang 32 in the corresponding end of section 24. Thus, the two sections 22 and 24 can be pivoted either outward, that is, away from each other, or inward, that is, toward each other.

Figure 2:
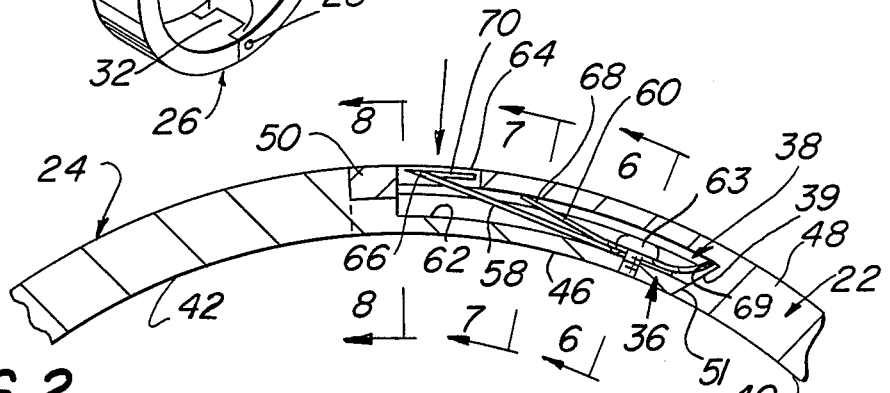
FIG. 2 is an enlarged sectional view of portions of the ring shown in FIG. 1, with the ring arranged in its fully closed or locked position.

In order to open the ring to enable it to be placed about the finger of a person without necessitating its being slid over the knuckle of the person, the two sections are pivoted outward to separate them like shown in FIG. 2. Once the person's finger is disposed between the two open sections the sections are pivoted toward each other until they are closed and locked together, like shown in FIG. 1. When the two sections are in the position like shown in FIG. 1 they are locked together by a latch mechanism and the ring has the appearance of a conventional, non-openable, ring. Thus, the ring of this invention is of particular utility by persons having enlarged knuckles, e.g., arthritic persons, since the ring can be worn without necessitating its being slid over the wearer's knuckle.

The details of the latch mechanism 34 will be described later. Suffice for now to state that the latch mechanism consist of mating male and female elements 36 and 38, respectively, as shown in FIGS. 2–4 and 6–8, and releasably secureable primary and secondary locking mechanisms.

As can be seen in FIG. 1 the inner surface 40 of the section 22 and the inner surface 42 of section 44 are both semicircular and of the same radius so that when the ring is in the closed position, like shown in FIGS. 1 and 2, the inner surfaces 40 and 42 are aligned with each other to form a continuous, smooth circular inner surface like any conventional finger ring.

The male element 36 of the latch mechanism 34 is shown clearly in FIGS. 2–4 and basically comprises a rigid extension or tongue which projects away from the free end 44 of the semicircular section 24. The extension 36 is arcuate in shape, with its inner surface 46 having the same radius of curvature as the inner surface 44 of section 24.

As can be seen in FIGS. 4–8, and as will be described in considerable detail later, the extension 36 includes a portion contiguous with its free end 51 which is of rectangular cross-section but becomes of trapezoidal cross-section from approximately a mid-point along the length of the extension toward the point where it merges with semi-circular section 24. Thus, as can be seen in FIG. 6–8, the sides 52 of the extension 36 are vertical at the free end 51 of the extension but form flared cam surfaces 54 from the mid-point rearward. The rectangular/trapezoidal portions of the extension are arranged to engage corresponding portions of the female element 38 of the latch means 34. Thus, as can be seen in FIG. 3, the female element 38 basically comprises an elongated recess extending in the end portion of section 22. The recess 38 includes an open mouth 48 extending along the inner surface of the semi-circular section 22. The recess is also open at the free end 50 of section 22. The lower or inner portion of the recess, that is the portion of the recess 38 contiguous with its mouth 48 is of generally trapezoidal cross-section adjacent the free end 50 but becomes of generally rectangular cross-sectional shape from approximately the mid-point along its length rearward. Ttus, the side walls 55 of the recess 38 contiguous with free end 50 are completely vertical but form flared cam surfaces 56 along the inner part of the recess, that is, the portion of the recess closest to the center of the ring, from approximately the mid-point of the recess rearward. The shape of the extension 36 and of the recess 38 facilitates the insertion of the extension into the recess as the two sections 22 and 24 are pivoted toward each other notwithstanding that the ring is formed of a rigid material so that it does not bend.

In order to releasably secure the two sections 22 and 24 together against accidental disconnection, the latch means 34 includes a pair of locking spring elements 58 and 60.

The spring element 58 serves as the primary locking mechanism for the ring 20. Thus it locks the two sections 22 and 24 together when the sections are fully closed like shown in FIG. 1. The spring element 60 serves as the secondary or back-up locking mechanism to prevent the ring from fully opening in the event the primary locking mechanism is accidentally opened.

Each spring element is of a generally leaf-spring shape. The spring elements are secured to the top surface 62 of the extension 36 adjacent its free end 51 by releasable securement means, e.g., screw 63. Each spring portion extends backward from the free end portion of the extension toward semi-circular section 24. A portion of each spring element near its free end forms a respective locking member for cooperation with a portion of the ring section 22. In particular each locking mechanism is arranged to engage a stepped wall portion 50 of the semi-circular section 22 contiguous with a small aperture 64. The aperture is shown clearly in FIGS. 2 and 3 and extends through section 22 communicating with recess 38 adjacent its free end. The aperture serves to provide access to the interior of the latch means to effect the flexing of the springs to release the latch mechanism when it is desired to open the ring for removal from or disposition on the wearer's finger. Thus, aperture is small in size to enable only relatively sharply pointed objects, such as a pencil or pen point, to be inserted therein to release the springs of the latch mechanism. This feature acts to deter accidental opening of the ring.

As mentioned earlier the spring element 58 serves as the primary locking mechanism for the ring 20. To that end the free end 66 of element 58 is arranged to abut the stepped wall portion 50 contiguous with aperture 64 when the ring is in its fully closed position as shown in FIG. 2. With the free end 66 of spring element 58 located under the aperture 64 its inherent resiliency or bias brings it into engagement with wall portion 50. This action secures the two sections 22 and 24 of the ring together so that they are precluded from pivoting away from each other, thereby effectively locking the ring against accidental disconnection while enabling it to be opened when a pointed object is inserted in the aperture 64.

The other spring element 60 in acting as a backup for the spring element 58, prevents the ring from opening completely in the event that the free end 66 of primary spring element 58 should be accidentally flexed downward and out of engagement with wall portion 50. In such a case the two sections 22 and 24 of the ring will attempt to open, that is start to pivot away from each other. However, as the two sections pivot outward the free end 68 of spring element 60 moves into engagement with the stepped wall portion 50 contiguous with aperture 64. This action prevents the ring from opening further, that is completely separating.

In order to prevent dust or other debris from entering into the interior of the latch mechanism through aperture 64 when the ring is closed the spring element 58 includes a finger 70 projecting out of the plane thereof adjacent the spring's free end. The finger 70 is shaped to fit closely within aperture 64 to effectively seal the aperture off from the ingress of dirt when the ring is in the fully closed state.

Figure 9:
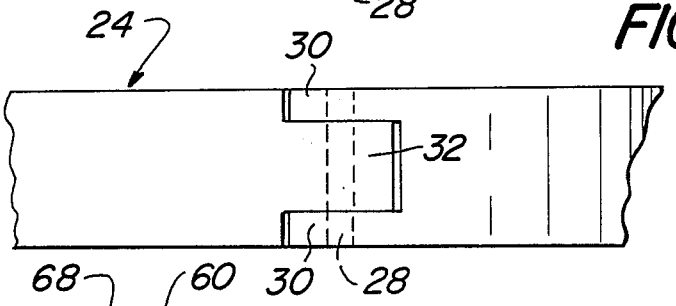
FIG. 9 is an exploded perspective view of one embodiment of spring means for the ring shown in FIG. 1.
Figure 9:
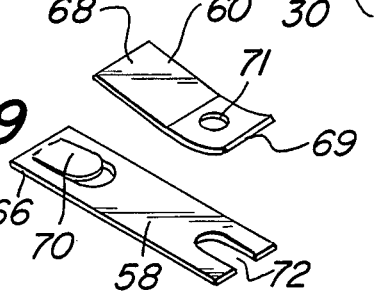
Figure 10:
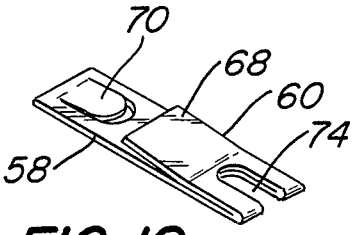
FIG. 10 is a perspective view of another embodiment of spring means for the subject invention.

The spring elements 58 and 60 can be formed by a pair of separate members, like that shown in FIGS. 1 and 9, or as a single member, like that shown in FIG. 10. In either case the spring element(s) are formed of a resilient material so that each's natural bias causes its respective free end to engage the stepped wall portion 50 contiguous with the aperture 64 when its free end is located thereunder.

In the preferred embodiment shown in FIGS. 1 and 9 the spring element 60 is a separate element from element 58. Thus, as can be seen spring element 60 includes an end 69 which is curved or bent upward out of the plane of its mid portion so as to engage and resiliently bear against the top surface of recess 38 when the ring is fully closed. This action provides a bias force tending to push the end of the extension 36 out of the recess 38 in the direction toward the center of the ring. However, when the ring is fully closed the inclined free end 51 of the extension 36 engages the inclined end wall 39 of the recess 38 to hold the extension in place. This arrangement wherein the inclined end wall of the recess overhangs the inclined free end 51 of the rigid extension, in addition to maintaining the extension within the recess, assists in the smooth transfer of bending moments from one section of the ring to the other, while the ring is being worn.

As mentioned earlier the spring members are secured to the free end of the extension 36 via screw 63. In particular the screw 63 extends through a hole 71 in the spring element 60 and through an elongated slot 72 in the spring element 58 of the embodiment shown in FIG. 9. With the embodiment of the spring of FIG. 10 the screw 63 extends through an elongated slot 74 which is common to the integrally formed elements 58 and 60. In either case the slot through which the screw passes enables the position of the associated spring element to be adjusted along the length of the extension 36, to thereby enable the spring to be used for various size rings.

Use of the ring is as follows: in order to open the ring one places his or her index finger on the inside surface of the hinge 26 while holding the opposite side of the hinge firmly against the relatively hard surface. Alternatively, one places his or her thumb on the inside of the hinge while holding the outside of the hinge firmly against the index finger. In the embodiments shown in FIGS. 1 and 9 the bias provided by the end 69 of spring 60 on the top surface of the recess 38 may, itself, be sufficient to cause to two sections to pivot apart without the need for finger pressure on the hinge when the latch mechanism is released.

To release the latch mechanism, a pin or the tip of a ball point pen, pencil or other sharply pointed instrument, is inserted through the aperture 64 to depress the free end of the primary spring element 58. This action frees the end of the spring from engagement with stepped wall portion 50, thereby enabling the section 24 to be pivoted about pin 28 away from section 22 (under the force provided by the finger of the user and/or by the bias provided by portion 69 of spring 60) until the free end 68 of the secondary or back-up spring 60 enters into abutment with the stepped wall portion 50. In this position the ring is partially open.

If the wearer's knuckle is sufficiently small, the ring need not be opened further in order to slide it over the knuckle and into wearing position. If, however, the knuckle is too large to enable the partially open ring to be slid thereover, the ring can be fully opened, that is, the ends of sections 22 and 24 opposite hinge 26 completely separated from each other. Thus, in order to fully open the ring the pointed instrument must be reinserted through the aperture 64 to cause the free end 68 of the secondary spring 60 to move out of engagement with the wall portion 50, whereupon the two sections 22 and 24 can be pivoted fully apart to completely open the ring.

The fully opened ring can then be placed on the finger of the wearer and the two sections 22 and 24 manually pivoted toward each other. In such an operation the free end 51 of the extension 36 enters into the recess 38 through its open mouth 48 at the free end 50 thereof. Thus, the wall portion of the section 22 continguous with the free end of recess 38 first engages the secondary spring 60 to deflect it downward as the extension 36 slides into the recess, (See the phantom lines in FIG. 3). As the extension slides further into the recess its cam surfaces 54 begin to engage the inclined side wall surfaces 56 of the recess 38, thereby guiding the extension down the recess. As the extension moves further down the recess the wall portion of section 22 contiguous with the end of the recess 38 then engages the primary spring 58 to deflect it downward. When the extension 36 is fully within the recess 38 the free end 66 of the primary spring 58 is located under aperture 64. At this point, the natural resiliency or bias of the spring causes its free end 66 to rise into engagement with stepped wall portion 50 with an audible click. This action has the effect of not only locking or latching the ring in its closed state, but also providing the wearer with an audible indication that the ring is so locked.

With the ring locked in place it is now resistant to accidental removal. In this regard in order for the ring to even partially open the primary locking spring 58 will have to be deflected downward by something gaining ingress through the small aperture 64. The chance of such an occurence is remote. However, even if the primary locking spring is pivoted downward so that its free end moves out of abutment with the wall portion 50 whereupon the two sections of the ring attempt to open, the secondary or backup spring element 60 takes over. In such a case the secondary spring's free end will engage the wall portion 50 to prevent the ring from opening further.

As will be appreciated from the foregoing the ring of the subject invention is the viable means for enabling persons who otherwise could not wear a ring due to the existence of large knuckles to wear a ring which to all intents and purposes has the appearance of a conventional finger ring. Moreover, due to its safety latching mechanism the ring of the subject invention provides a positive deterrent to accident opening.

Without further elaboration, the foregoing will so fully illustrate my invention that others may, by applying current or future knowledge, readily adopt the same for use under various conditions of service.

I claim:

1. A ring to be worn as an article of jewelry by a person, said ring comprising a first arcuate section having an outer peripheral surface and a recess spaced inwardly from said outer peripheral surface, an aperture located adjacent the free end of said recess and communicating with said recess and with said outer peripheral surface and a wall portion adjacent said aperture; a second arcuate section pivotably connected to said first arcuate section and having a rigid, arcuate extending member projecting therefrom and adapted to move through said recess from a partially open position, wherein said extending member is located partially within said recess, to a closed position, wherein said extending member is located fully within said recess; a first resilient member connected to said rigid, arcuate extending member for providing a first spring means connected thereto and having a first locking portion, and second locking means connected to said extending member and having a second locking portion; said first locking portion being adapted to engage the wall portion of said first section without any portion of said first resilient member extending through said aperture beyond said outer peripheral surface when said extending member is fully disposed within said recess to thereby lock said first section to said second section, said second locking means being adapted to engage a portion of said first section when said extending member is partially disposed within said recess, said aperture in said first section providing access to said first spring means to enable its locking portion to be moved out of engagement with said wall portion to enable said first section to be pivoted from said second section so that said ring can assume said partially open position.

2. The ring of claim 1 wherein said second locking means comprises second spring means having a second locking portion adapted to engage the wall portion of said first section when the extending member is partially disposed within said recess, and wherein said aperture in said first section provides access to said second spring means when said ring is in said partially opened position to enable said locking portion to be moved out of engagement with said wall portion to enable said first section be pivoted fully away from said second section.

3. The ring of claim 2 wherein said first and second spring means are releasably secured to said extending member.

4. The ring of claim 2 wherein one of said spring means is arranged to provide a bias force to said first arcuate section tending to cause said sections to pivot apart from each other when said first spring means is moved out of engagement with said wall portion.

5. The ring of claim 2 wherein the position of one of said spring means on said extending member is adjustable.

6. The ring of claim 2 wherein each of said spring means comprises a leaf spring, and wherein said first leaf spring has a slot therein, said second leaf spring has an opening therein, and wherein said spring means are connected to said extending member be screw means extending through said slot and said opening.

7. The ring of claim 2 wherein said first spring means includes a projecting portion adapted to fit with said aperture to prevent the ingress of material through said aperture into the interior of said recess.

8. The ring of claim 7 wherein said first and second spring means are formed as an integral unit.

9. The ring of claim 7 wherein said first and second spring means are separate elements.

10. The ring of claim 7 wherein one of said spring means is arranged to provide a bias force to said first arcuate section tending to cause said sections to pivot apart from each other when said first spring means is moved out of engagement with said wall portion.

11. A ring to be worn as an article of jewelry about a portion of a body of a person and comprising: a first rigid arcuate section having an arcuate inner surface, a recess in said first arcuate section extending along a portion of the arc of said first arcuate section and having an open free end, said recess also including an opening along said arcuate inner surface for communicating with the interior of the ring; a second, rigid arcuate section pivotally connected to said first arcuate section and having an inner surface and a rigid male extending member projecting therefrom and adapted to be inserted into the recess through the open free end of said recess and through the opening along said arcuate inner surface, said recess including a rear end wall, said rear end wall being inclined rearwardly in an outward direction from the arcuate inner surface of the first arcuate section and said male extending member including a free end wall inclined in the same direction as the rear end wall of the recess whereby the rear end wall of the recess overhangs the free end wall of the male extending member when said male extending member is fully inserted within said recess for smoothly transferring bending moments between said first and second rigid arcuate sections, and latching means for maintaining the male extending member in a position fully inserted within said recess.

12. The ring of claim 11 wherein said recess includes a portion of trapezoidal cross-section, and wherein said extending member includes a portion of trapezoidal cross-section.

13. The ring of claim 11 wherein the inner surface of each of said sections is semi-circular.

14. A ring to be worn as an article of jewelry about a portion of the body of a person, said ring comprising a first, rigid arcuate section having an arcuate inner surface, a recess in said first arcuate section extending along a portion of the arc of said first arcuate section and having an open free end, said recess also including an opening along said arcuate inner surface for communicating with the interior of the ring; a second, rigid arcuate section pivotally connected to said first arcuate section and having an inner surface and a rigid male extending member projecting therefrom, said rigid male extending member being moveable into the recess through the open free end of said recess and through the opening along said arcuate inner surface as said first and second arcuate sections are moved into a closed position, wherein the rigid male extending member is seated within the recess; a latching member having a locking portion moveable between a first position for retaining the first and second arcuate sections in the closed position, to a second position permitting said first and second arcuate sections to be moved out of said closed position, said latching member having a surface means for providing a bias force between said first and second arcuate sections for causing said sections to pivot apart from each other when said locking portion of the latching member is moved to its second position.

15. The ring of claim 14 wherein said latching member is a spring means.

16. The ring of claim 15 wherein said spring means is connected to said rigid extending member and has a locking portion for engaging a surface of said first arcuate section to maintain said first and second arcuate sections in a closed position.

* * * * *